US008146907B2

(12) United States Patent
Kato et al.

(10) Patent No.: US 8,146,907 B2
(45) Date of Patent: Apr. 3, 2012

(54) SHEET PROCESSING APPARATUS WITH IMPROVED PRODUCTIVITY, IMAGE FORMING SYSTEM AND IMAGE FORMING APPARATUS

(75) Inventors: Hitoshi Kato, Toride (JP); Naoki Ishikawa, Kashiwa (JP); Yasuo Fukatsu, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/902,613

(22) Filed: Oct. 12, 2010

(65) Prior Publication Data

US 2011/0089623 A1 Apr. 21, 2011

(30) Foreign Application Priority Data

Oct. 21, 2009 (JP) ..... 2009-242365

(51) Int. Cl.
*B65H 9/16* (2006.01)
*B65H 7/02* (2006.01)

(52) U.S. Cl. ..... 270/58.07; 270/58.12; 270/58.17; 270/58.27

(58) Field of Classification Search ..... 270/58.02, 270/58.07, 58.11, 58.12, 58.17, 58.27
See application file for complete search history.

(56) References Cited

U.S. PATENT DOCUMENTS 5,911,414 A 6/1999 Kato et al.
7,559,543 B2 * 7/2009 Moriyama et al. ..... 270/58.12
7,802,782 B2 * 9/2010 Moriyama et al. ..... 270/58.12

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus which is capable of improving the productivity of sheet processing as much as possible. An image forming apparatus forms an image on a sheet. A finisher is connected downstream of the image forming apparatus and performs post processing on the sheet. The finisher moves at least one of the sheet and a punching unit to adjust a position for punching holes in the sheet. The finisher determines whether or not a post-processing apparatus connected upstream of the finisher is provided with a correction mechanism for correcting a position of a sheet in a direction orthogonal to a sheet conveying direction. When the post-processing apparatus is provided with the correction mechanism, the finisher causes the image forming apparatus to be set such that a sheet conveying interval becomes shorter than when the post-processing apparatus is not provided with the correction mechanism.

5 Claims, 14 Drawing Sheets

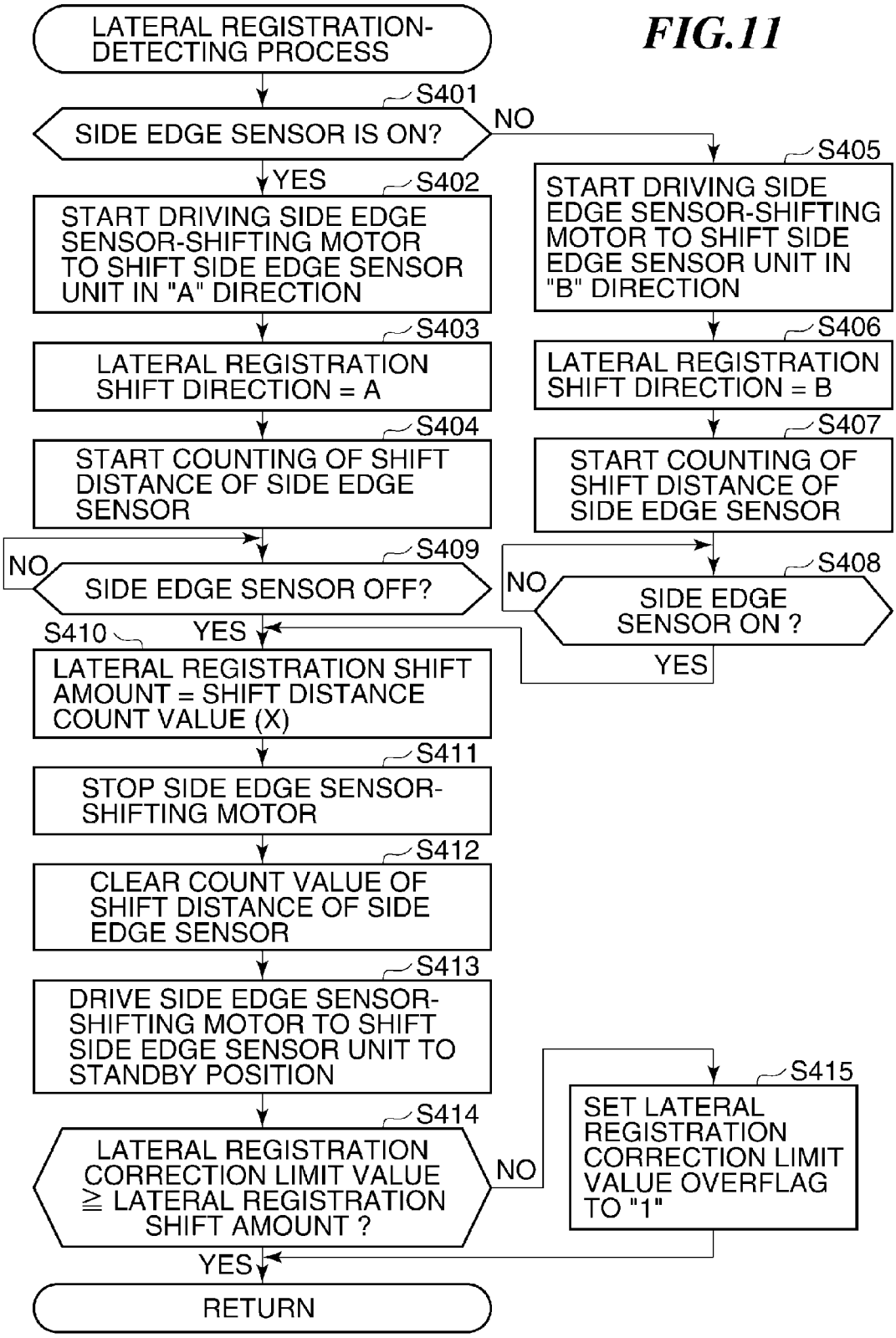
FIG.11
LATERAL REGISTRATION-DETECTING PROCESS
S401
SIDE EDGE SENSOR IS ON?
NO
YES
S402
START DRIVING SIDE EDGE SENSOR-SHIFTING MOTOR TO SHIFT SIDE EDGE SENSOR UNIT IN "A" DIRECTION
S403
LATERAL REGISTRATION SHIFT DIRECTION = A
S404
START COUNTING OF SHIFT DISTANCE OF SIDE EDGE SENSOR
S405
START DRIVING SIDE EDGE SENSOR-SHIFTING MOTOR TO SHIFT SIDE EDGE SENSOR UNIT IN "B" DIRECTION
S406
LATERAL REGISTRATION SHIFT DIRECTION = B
S407
START COUNTING OF SHIFT DISTANCE OF SIDE EDGE SENSOR
S408
SIDE EDGE SENSOR ON ?
NO
YES
S409
SIDE EDGE SENSOR OFF?
NO
YES
S410
LATERAL REGISTRATION SHIFT AMOUNT = SHIFT DISTANCE COUNT VALUE (X)
S411
STOP SIDE EDGE SENSOR-SHIFTING MOTOR
S412
CLEAR COUNT VALUE OF SHIFT DISTANCE OF SIDE EDGE SENSOR
S413
DRIVE SIDE EDGE SENSOR-SHIFTING MOTOR TO SHIFT SIDE EDGE SENSOR UNIT TO STANDBY POSITION
S414
LATERAL REGISTRATION CORRECTION LIMIT VALUE ≧ LATERAL REGISTRATION SHIFT AMOUNT ?
NO
YES
S415
SET LATERAL REGISTRATION CORRECTION LIMIT VALUE OVERFLAG TO "1"
RETURN

SHEET PROCESSING APPARATUS WITH IMPROVED PRODUCTIVITY, IMAGE FORMING SYSTEM AND IMAGE FORMING APPARATUS

BACKGROUND OF THE INVENTION

1. Field of the Invention

The present invention relates to a sheet processing apparatus connected downstream of an image forming apparatus that forms an image on a sheet, an image forming system, and an image forming apparatus.

2. Description of the Related Art

Conventionally, there has been known a sheet processing apparatus of a type that punches holes in image-formed sheets, on a sheet-by-sheet basis, while conveying each of them.

In sheet processing apparatuses of the above-mentioned type, a sheet can undergo a shift in position in a direction orthogonal to a sheet conveying direction (the shift will be hereinafter referred to as "lateral registration shift"). To correct such a shift, there has been proposed a sheet processing apparatus that detects a lateral registration shift using a lateral registration-detecting unit, and then moves a punching unit based on a result of the detection, to thereby align a punching position with a target position on the sheet (see e.g. U.S. Pat. No. 5,911,414). Further, there has been proposed another sheet processing apparatus that moves a sheet itself using a sheet shifting unit based on a result of the detection, to thereby align a punching position with a target position on the sheet.

FIGS. 14A and 14B are timing diagrams showing relationship in timing between lateral registration correction and punching. FIG. 14A shows timing in a case where the amount of lateral registration shift is relatively large, and FIG. 14B shows timing in a case where the amount of lateral registration shift is relatively small. It should be noted that each horizontal axis represents time (elapsed time).

In FIGS. 14A and 14B, each of respective operation zones 1201A and 1201B ("A and B" will be hereinafter omitted) represents a time section during which the lateral registration shift of a sheet is detected. An operation zone 1202 represents a time section during which the lateral registration shift detected in the operation zone 1201 is corrected. To correct the lateral registration shift, there have conventionally been proposed a method of moving the punching unit and a method of moving the sheet per se using the sheet shifting unit, as mentioned above, and in the examples illustrated in FIGS. 14A and 14B, the latter method is employed. An operation zone 1203 represents a time section during which the punching unit punches holes in the sheet. Since in the illustrated example, the method of moving the sheet per se using the sheet shifting unit is employed for lateral registration correction, a punching processing execution time period from a time point when the leading end of the shift is conveyed into an area in the sheet processing apparatus for punching processing including lateral registration correction to a time point when the trailing end of the sheet leaves the area after the sheet is subjected to lateral registration correction and punching processing is equal to the sum of a time period required for the sheet to pass through the area and a time period required for performing the punching processing while holding the sheet stationary. Therefore, as shown in FIGS. 14A and 14B, the punching processing execution time period does not change between the case where the amount of lateral registration shift is relatively large and the amount of lateral registration shift is small, but it is constant. An operation zone

1204 represents a time zone during which the sheet shifting unit for lateral registration correction moves to its standby position, and a time period corresponding to the operation zone 1204 is equal to a time period obtained by subtracting the aforementioned punching processing execution time period from a punching processing time period as a total time period concerning a punching process performed by the sheet processing apparatus. A solid line 1205 represents changes in sheet conveying speed, and the vertical axis represents the speed. It should be noted that a horizontal broken line 1206 represents a state where the sheet conveying speed is equal to "0", i.e. where the sheet is stationary.

When the method of moving the punching unit is employed for lateral registration correction, the punching processing time period becomes different in that at a time point the punching processing executed in the operation zone 1203 is completed, the punching unit is permitted to move to the standby position. However, even when either the method performed by moving the punching unit or the method performed by moving a sheet is employed for lateral registration correction, it takes longer for the punching unit or the sheet shifting unit to return to its standby position as the amount of lateral registration shift is larger, as can be understood from FIGS. 14A and 14B. In other words, as the amount of lateral registration shift is larger, the productivity in sheet processing can become lower.

On the other hand, in recent years, there has appeared on the market an image forming system which is configured such that a plurality of sheet processing apparatuses can be connected downstream of an image forming apparatus so as to perform various kinds of post processing, such as case binding, saddle stitching, folding, and punching. An image forming system of this type can be easily realized in a user's desired one of configurations ranging from a simple one in which only a finisher is connected to an image forming apparatus to a complicated one in which a number of post-processing apparatuses are connected to the image forming apparatus. Further, conventionally, in such an image forming system, a sheet conveying interval is determined such that lateral registration correction for punching can be properly performed even for a maximum lateral registration shift.

By the way, a post-processing apparatus connected upstream of a sheet processing apparatus provided with a punching unit is sometimes equipped with a unit for correcting a lateral registration shift. In this case, the amount of lateral registration shift of a sheet conveyed into the sheet processing apparatus is smaller than in a case where the post-processing apparatus is not equipped with the lateral registration correcting unit. That is, in this case, the distance becomes shorter over which the punching unit or the sheet shifting unit is moved for correction of the lateral registration shift. As a consequence, the punching processing time period (punching processing execution time period including time period required for lateral registration correction+time period required for the sheet shifting unit to return to the standby position) is reduced (see FIG. 14B), which permits reduction of the sheet conveying interval.

However, in the above-described conventional image forming system, the sheet conveying interval is fixed, and it is determined according to a condition that the amount of lateral registration shift is the maximum. In this case, therefore, surplus time unnecessary for operation is produced, which unnecessarily lowers the productivity of sheet processing.

Further, when the number of post-processing apparatuses connected in series upstream of the sheet processing apparatus provided with the punching unit is small, the lateral registration shift of a sheet conveyed into the sheet processing apparatus is smaller than when a larger number of post-processing apparatuses are connected to the sheet processing apparatus. In that case as well, in the conventional image forming system, surplus time unnecessary for operations is produced for the same reason as mentioned above, which unnecessarily lowers the productivity of sheet processing.

SUMMARY OF THE INVENTION

The present invention provides a sheet processing apparatus which is capable of improving the productivity of sheet processing as much as possible, an image forming system, and an image forming apparatus.

In a first aspect of the present invention, there is provided a sheet processing apparatus connected downstream of an image forming apparatus that forms an image on a sheet, comprising a post-processing unit configured to perform post processing on the sheet, a shift unit configured to shift at least one of the sheet and the post-processing unit so as to adjust a position for performing the post processing on the sheet, a determination unit configured to determine whether or not a post-processing apparatus connected between the sheet processing apparatus and the image forming apparatus is provided with a correction mechanism for correcting a position of a sheet in a direction orthogonal to a sheet conveying direction, and a setting unit configured to be operable when the determination unit determines that the post-processing apparatus is provided with the correction mechanism, to cause the image forming apparatus to be set such that a conveying interval of sheets becomes shorter than when the post-processing apparatus is not provided with the correction mechanism.

In a second aspect of the present invention, there is provided a sheet processing apparatus connected downstream of an image forming apparatus that forms an image on a sheet, comprising a post-processing unit configured to perform post processing on the sheet, a shift unit configured to shift at least one of the sheet and the post-processing unit so as to adjust a position for performing the post processing on the sheet, a determination unit configured to determine a number of post-processing apparatuses connected between the sheet processing apparatus and the image forming apparatus, and a setting unit configured to cause the image forming apparatus to be set such that a conveying interval of sheets becomes shorter as the number of the post-processing apparatuses determined by the determination unit is smaller.

In a third aspect of the present invention, there is provided an image forming system comprising an image forming unit configured to form an image on a sheet, a sheet feed unit configured to feed the sheet to the image forming unit, a post-processing unit configured to perform post processing on the sheet, a shift unit configured to shift at least one of the sheet and the post-processing unit so as to adjust a position for performing the post processing on the sheet, a determination unit configured to determine whether or not a correction mechanism for correcting a position of the sheet in a direction orthogonal to a sheet conveying direction is provided between the shift unit and the image forming unit, and a control unit configured to be operable when the determination unit determines that the correction mechanism is provided, to control the sheet feed unit such that a sheet feeding interval of sheets becomes shorter than when the correction mechanism is not provided.

In a fourth aspect of the present invention, there is provided an image forming system comprising an image forming apparatus configured to form an image on a sheet, at least one post-processing apparatus configured to perform post-processing on a sheet discharged from the image forming apparatus, one of the at least one post-processing apparatus having a post-processing unit configured to perform post processing on the sheet, a shift unit configured to shift at least one of the sheet and the post-processing unit, so as to adjust a position for perform post processing on the sheet, a determination unit configured to determine a number of post-processing apparatuses connected between the post-processing unit and the image forming apparatus, and a control configured be operable based on a result of determination by the determination unit, to make shorter a sheet discharge interval of sheets discharged from the image forming apparatus as the number of the post-processing apparatuses is smaller.

In a fifth aspect of the present invention, there is provided an image forming apparatus connected to a plurality of post-processing apparatuses, the plurality of post-processing apparatuses including a specific post-processing unit that performs predetermined post-processing, comprising an image forming unit configured to form an image on a sheet, a sheet feed unit configured to feed the sheet to the image forming unit, and a control unit configured to, when an intermediate post-processing apparatus connected between the image forming apparatus and the specific post-processing apparatus is provided with a correction mechanism for correcting a position of the sheet in a direction orthogonal to a sheet conveying direction, control the sheet feed unit such that a feeding interval of sheets becomes shorter than when the intermediate post-processing apparatus is not provided with the correction mechanism.

In a sixth aspect of the present invention, there is provided a sheet processing apparatus connected downstream of an image forming apparatus that forms an image on a sheet, comprising a post-processing unit configured to perform post processing on the sheet, a shift unit configured to shift at least one of the sheet and the post-processing unit so as to adjust a position for performing the post processing on the sheet, a determination unit configured to determine whether a correction mechanism for correcting a position of a sheet in a direction orthogonal to a sheet conveying direction is provided between the sheet processing apparatus and the image forming apparatus, and a setting unit configured to be operable when the determination unit determines that the correction mechanism is provided, to cause the image forming apparatus to be set such that a conveying interval of sheets becomes shorter than when the correction mechanism is not provided.

According to the present invention, when an apparatus connected upstream of a sheet processing apparatus provided with a post-processing unit is equipped with a lateral registration-correcting mechanism and when the amount of lateral registration shift of a sheet caused during conveyance of the sheet into the sheet processing apparatus is small, the sheet conveying interval is reduced, and therefore it is possible to improve the productivity of the punching process.

Further, when the number of apparatuses connected upstream of the sheet processing apparatus provided with the post-processing unit is small and when the amount of lateral registration shift of a sheet caused during conveyance of the sheet into the sheet processing apparatus is small, the sheet conveying interval is reduced, and therefore it is possible to improve the productivity of punching.

Furthermore, when a sheet undergoes a larger lateral registration shift than expected, the sheet is discharged onto a proof tray (abnormal sheet discharge tray) where only abnormal sheets are stacked, for separation, and the sheet conveying interval of subsequent sheets is increased, so that the operation can be properly continued.

Further features of the present invention will become apparent from the following description of an exemplary embodiment with reference to the attached drawings.

BRIEF DESCRIPTION OF THE DRAWINGS

FIG. 11 is a detailed flowchart of a lateral registration-detecting process executed in FIG. 10.

DETAILED DESCRIPTION OF THE EMBODIMENTS

The present invention will now be described in detail below with reference to the accompanying drawings showing an embodiment thereof.

Figure 1:
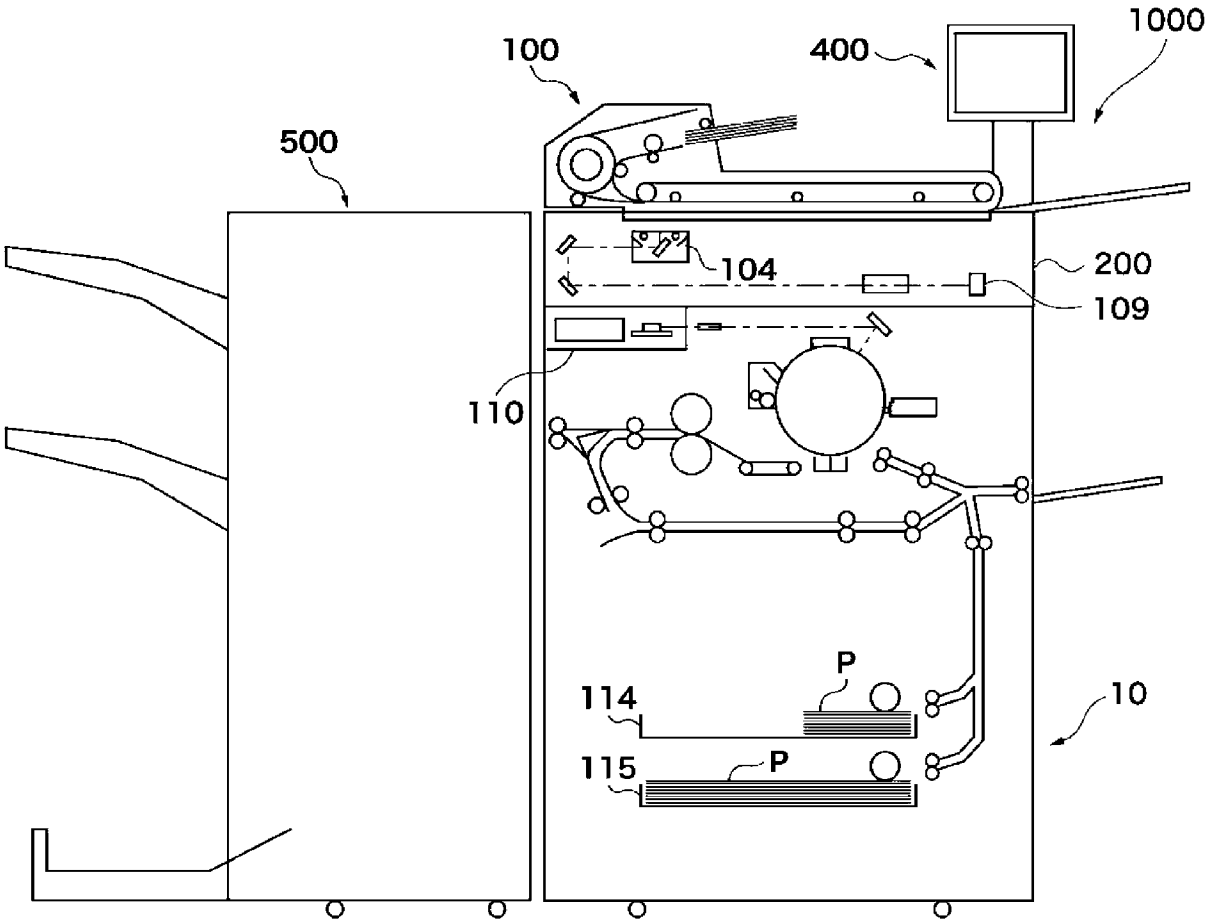
FIG. 1 is a view schematically showing the internal construction of an image forming apparatus according to an embodiment of the present invention.

FIG. 1 is a view schematically showing the internal construction of an image forming apparatus 10 according to the embodiment of the present invention. In the example shown in FIG. 1, there is illustrated an image forming system 1000 formed by connecting a finisher 500 as a sheet processing apparatus according to the embodiment to the image forming apparatus 10.

The image forming apparatus 10 is capable of changing the sheet feeding interval of sheets fed from a sheet feed cassette 114 or 115 to thereby control the change of the conveying interval of sheets P to be conveyed to the finisher 500. The conveying interval is defined as a time period from a time point when the leading end of a preceding sheet P reaches an inlet roller 502 (see FIG. 3) of the finisher 500 to a time point when the leading end of a sheet P subsequent to the preceding sheet P reaches the inlet roller 502.

Figure 2:
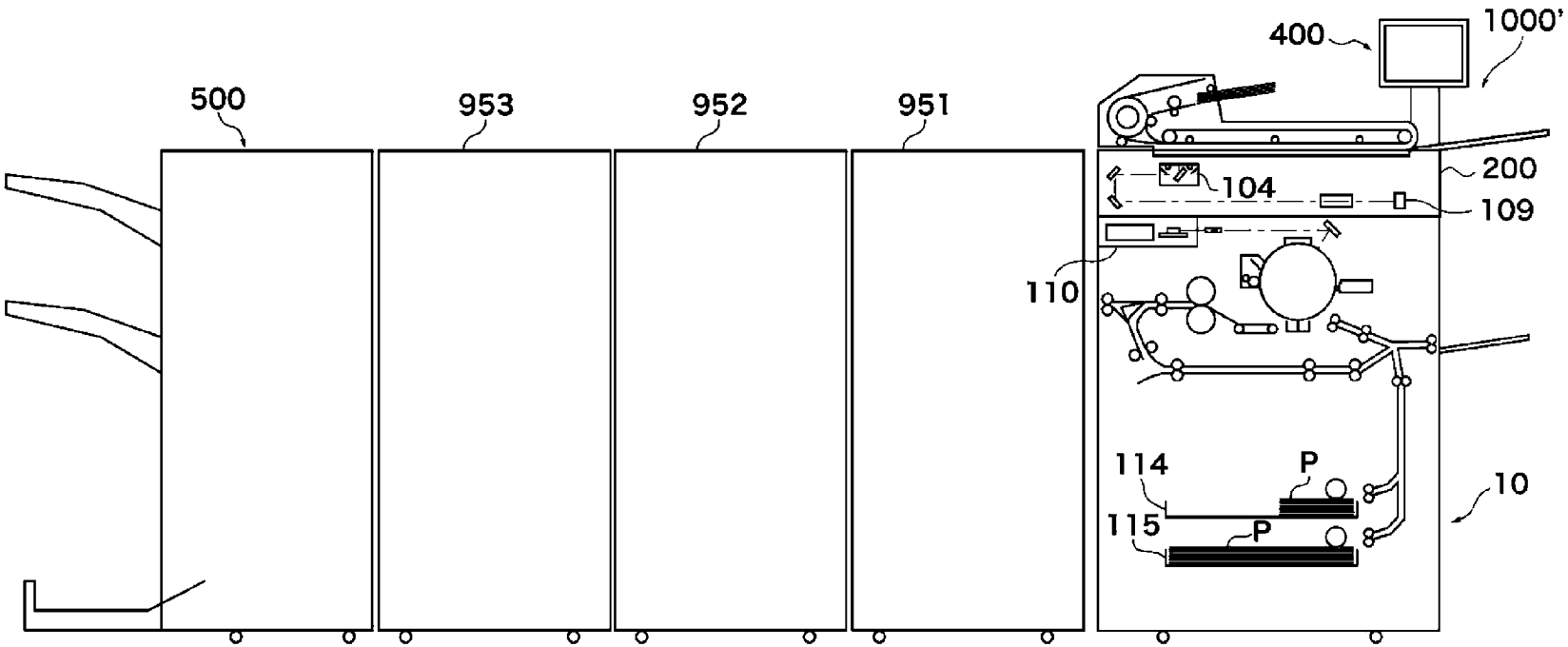
FIG. 2 is a view of an image forming system formed by connecting not only a finisher appearing in FIG. 1 but also a plurality of kinds of post-processing apparatuses to the image forming apparatus.

FIG. 2 is a view of an image forming system 1000' formed by connecting not only the finisher 500 but also a plurality of kinds (e.g. three kinds) of post-processing apparatuses 951 to 953 in series to the image forming apparatus 10. The image forming apparatus 10 is thus configured such that a plurality of post-processing apparatuses can be connected thereto.

Figure 3:
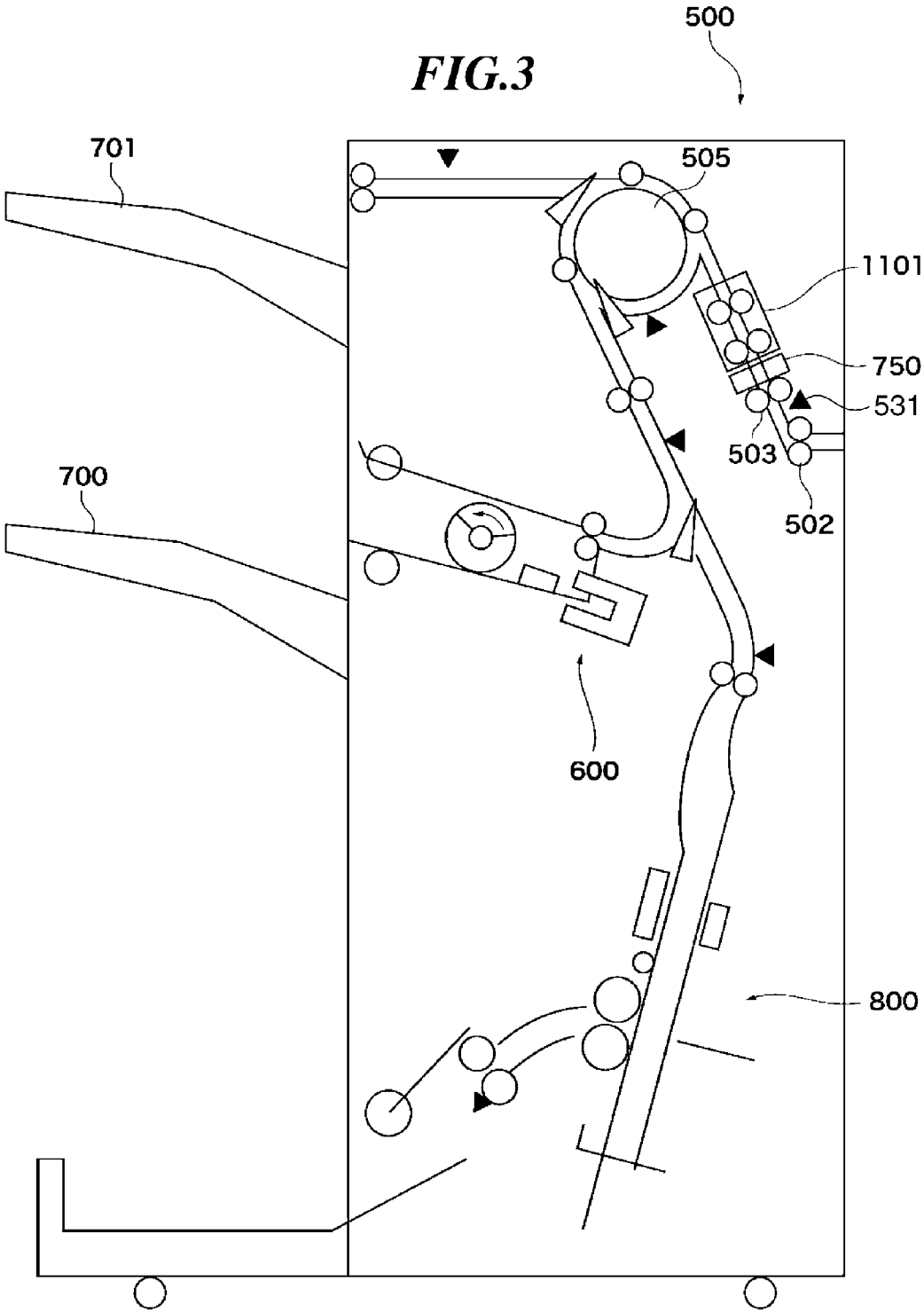
FIG. 3 is a view schematically showing the internal construction of the finisher appearing in FIG. 1.

FIG. 3 is a view schematically showing the internal construction of the finisher 500.

The finisher 500 performs a process for aligning and sorting sheets P conveyed from the image forming apparatus 10, a sorting process or a non-sorting process. Further, the finisher 500 performs a stapling process (binding process) for stapling the trailing end of a sheet bundle, a punching process for punching holes in the trailing end of a sheet P, a bookbinding process, and so forth. Therefore, the finisher 500 comprises a punching unit 750 for punching holes in a sheet, a stapler unit 600 for stapling a sheet bundle, and a bookbinding unit 800 for performing the bookbinding process for folding a sheet bundle in two and binding the same.

Between a conveying roller pair 503 and a buffer roller 505, there is disposed a shift unit (sheet shifting unit) 1001. In a case where a shift sorting mode for transversely offsetting each sheet P and discharging the same or a punch mode for punching holes in each sheet P is selected, the shift unit 1001 conveys the sheet P while shifting the same to a predetermined position in the lateral direction. The shift unit 1001 will be described in detail hereinafter.

The finisher 500 is provided with a tray 700 for stacking sheets P determined to have been normally processed thereon, and a proof tray (abnormal sheet discharge tray) 701 for stacking sheets P determined to have been abnormally processed.

Figure 4:
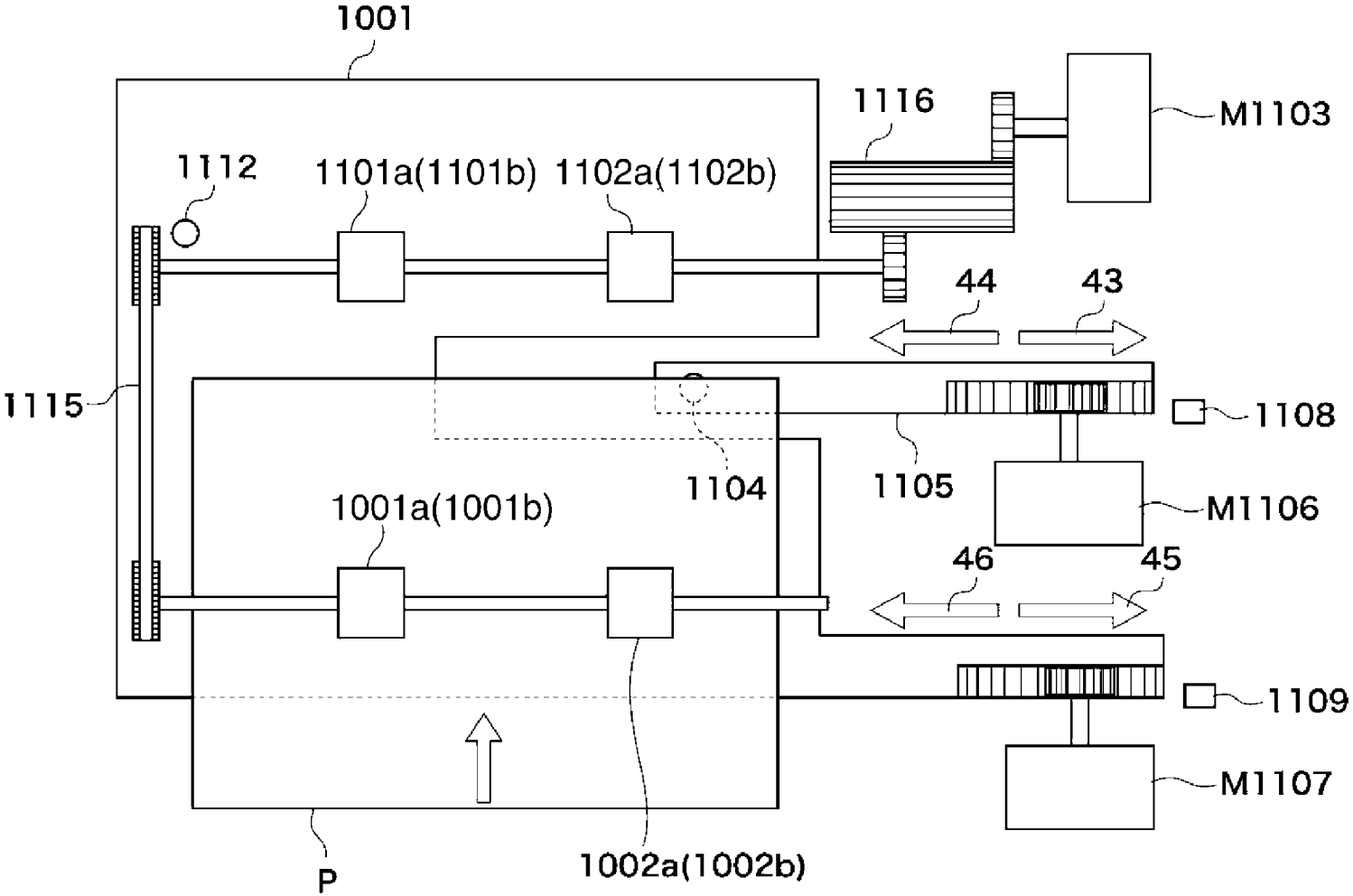
FIG. 4 is a schematic view of a shift unit appearing in FIG. 3.

FIG. 4 is a schematic view of the shift unit 1001.

Referring to FIG. 4, a conveying motor M1103 applies a driving force to conveying rollers 1101*a* and 1102*a* via a gear 111, and to conveying rollers 1001*a* and 1002*a* further via a timing belt 1115, whereby the conveying rollers 1101*a* and 1102*a* and the conveying rollers 1001*a* and 1002*a* cooperate with driven rollers 1101*b* and 1102*b* as well as driven rollers 1001*b* and 1002*b* (hidden behind the respective associated conveying rollers 1101*a*, 1102*a*, 1001*a* and 1002*a* in FIG. 4), respectively, to convey a sheet P.

The leading end of a sheet P being conveyed is detected by a side edge sensor 1104 as a position detector unit. The side edge sensor 1104 is mounted on a side edge sensor unit 1105. The side edge sensor unit 1105 is configured to be driven by a side edge sensor-shifting motor M1106 such that it can be moved in the left-right directions, as viewed in FIG. 4, indicated by arrows 44 and 43, respectively. The home position of the side edge sensor unit 1105 is detected by an HP sensor 1108.

A shift motor M1107 drives the shift unit 1001 provided separately from the side edge sensor unit 1105, to move the unit 1001 in the left-right directions, as viewed in FIG. 14, indicated by arrows 46 and 45, respectively. The home position of the shift unit 1001 is detected by an HP sensor 1109.

A trailing end-detecting sensor 1112 not only detects a sheet P being conveyed, but also detects that the trailing end of the sheet P has left the conveying rollers 1101*a* and 1101*b* within the shift unit 1001.

Figure 5:
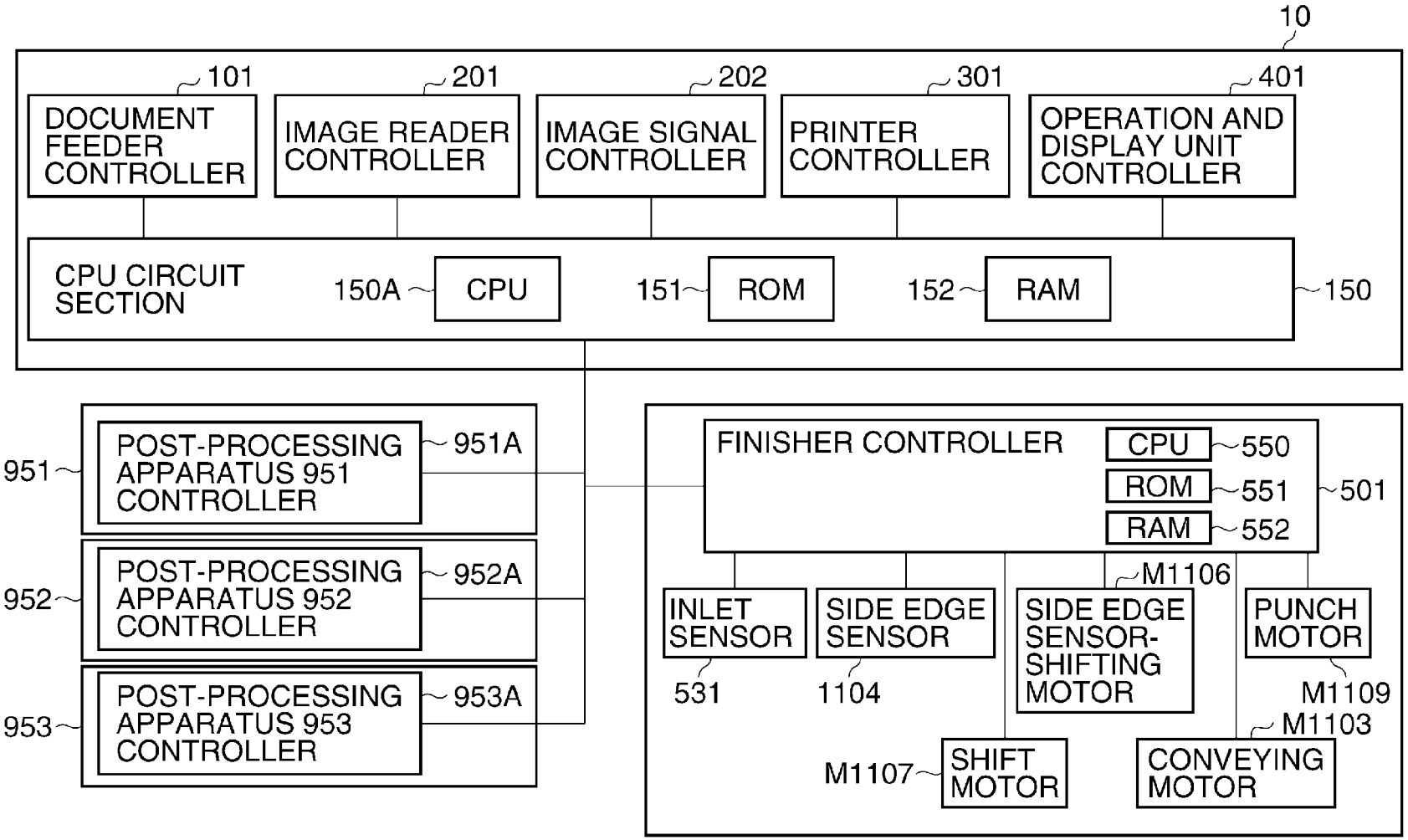
FIG. 5 is a control block diagram of the image forming system.

FIG. 5 is a control block diagram of the image forming system.

The image forming apparatus 10 includes a CPU circuit section 150. The CPU circuit section 150 incorporates a CPU (Central Processing Unit) 150A, a ROM (Read Only Memory) 151, and a RAM (Random Access Memory) 152. The CPU 150A performs centralized control of a document feeder controller 101, an image reader controller 201, an image signal controller 202, a printer controller 301, an operation and display unit controller 401, a finisher controller 501, and post-processing apparatus controllers 951A, 952A, and 953A, based on control programs stored in the ROM 151. The RAM 152 temporarily stores control data, and is also used as a work area for carrying out arithmetic operations involved in control processing by the CPU 150A.

The document feeder controller 101 drivingly controls a document feeder 100 (see FIG. 1) according to instructions from the CPU circuit section 150.

The image reader controller 201 drivingly controls a scanner unit 104 and an image sensor 109 (see FIG. 1), and so forth of a scanner 200, and transfers an analog image signal output from the image sensor 109 to the image signal controller 202.

The image signal controller 202 converts the analog image signal input from the image sensor 109 to digital signal, then performs various kinds of processing on the digital signal, converts the processed digital signal into a video signal, and delivers the video signal to the printer controller 301.

The printer controller 301 drives an exposure control unit 110 (see FIG. 1) based on the video signal received from the image signal controller 202.

The operation and display unit controller 401 exchanges information with an operation and display unit 400 (see FIG. 1) and the CPU circuit section 150. Specifically, the operation and display unit controller 401 outputs a key signal delivered from an operation section, not shown, of the operation and display unit 400 in accordance with an operation of each key, to the CPU circuit section 150, and displays, based on a signal from the CPU circuit section 150, information corresponding to the signal on a display section, not shown, of the operation and display unit 400.

The finisher controller 501 of the finisher 500 exchanges information with the CPU circuit section 150 of the image forming apparatus 10 to thereby control the overall operation of the finisher 500. It should be noted that the finisher controller 501 may be provided in the image forming apparatus 10.

The finisher controller 501 comprises a CPU 550, a ROM 551, and a RAM 552. The finisher controller 501 communicates with the CPU circuit section 150 provided in the image forming apparatus 10 via a communication IC, not shown, for data exchange, and executes various programs stored in the ROM 552 according to instructions from the CPU circuit section 150 to thereby control the driving of the finisher 500. Further, the finisher controller 501 controls each of the motors M1107, M1106 and M1103, and a punch motor M1109 based on signals from an in inlet sensor 531 and the side edge sensor 1104.

The post-processing apparatus controllers 951A, 952A, and 953A of the respective post-processing apparatuses 951 to 953 communicate with the CPU circuit section 150 of the image forming apparatus 10 via the communication IC, not shown, for data exchange, and control the respective post-processing apparatuses 951, 952, and 953 according to commands from the CPU circuit section 150.

Figure 6:
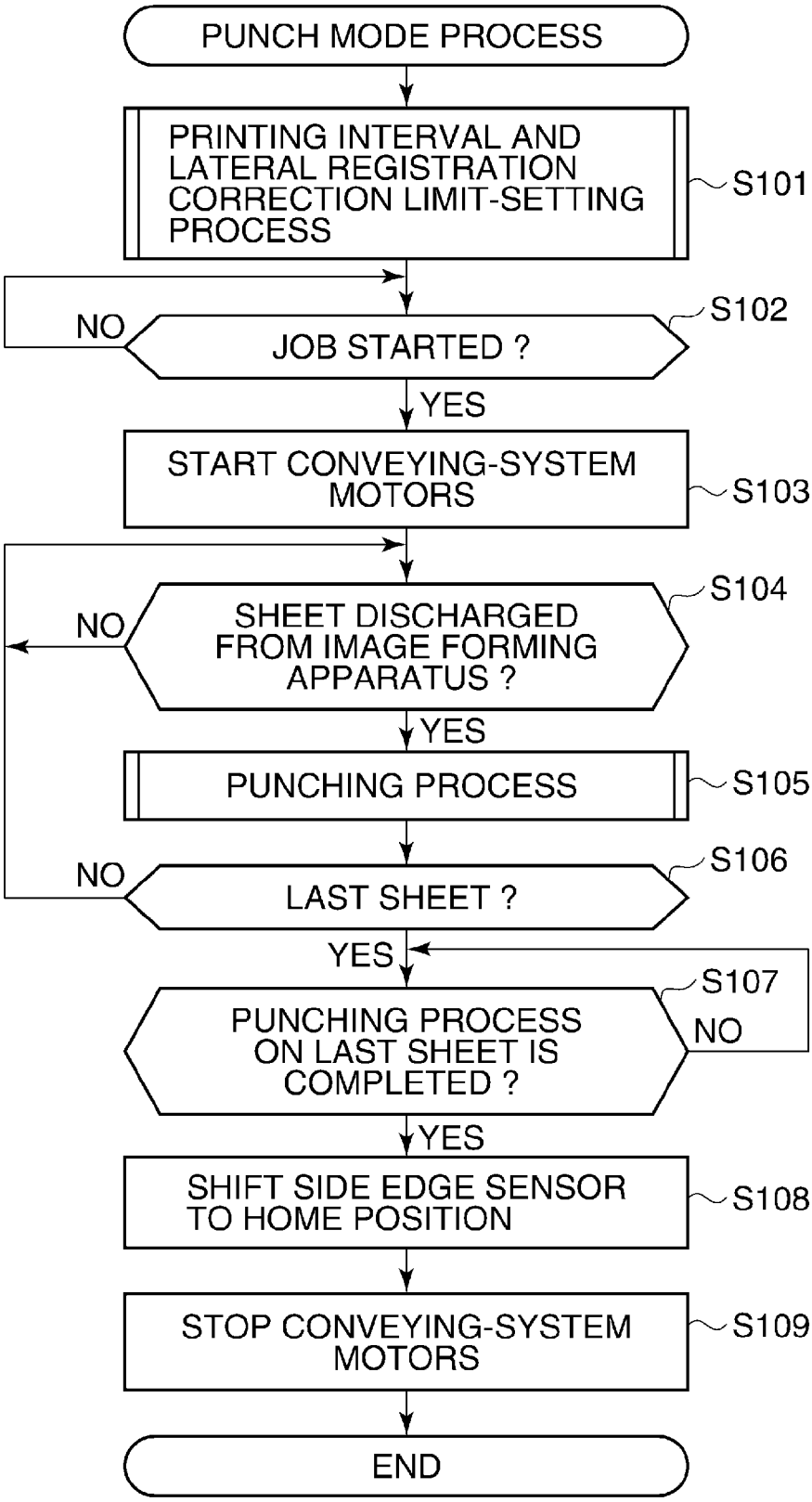
FIG. 6 is a flowchart of a punch mode process executed by a finisher controller appearing in FIG. 5.

FIG. 6 is a flowchart of a punch mode process executed by the finisher controller 501, particularly by the CPU 550. The present punch mode process is started according to an execution command from the CPU circuit section 150 of the image forming apparatus 10.

As shown in FIG. 6, first in a step S101, the CPU 550 executes a printing interval and lateral registration correction limit-setting process to set a printing interval (productivity) and a lateral registration correction limit value in the image forming apparatus 10. This setting process will be described in detail hereinafter with reference to FIG. 7.

Next, in a step S102, the CPU 550 awaits the start of a job. A job start signal indicative of the start of a job is sent from the CPU circuit section 150 of the image forming apparatus 10 to the finisher controller 501. Upon receipt of the job start signal, the CPU 550 starts the various motors of the conveying system, including the conveying motor M1103 (step S103).

Then, the CPU 550 awaits discharge of a sheet P from the image forming apparatus 10 (step S104). Whether or not a sheet P has been discharged from the image forming apparatus 10 is determined based on a signal sent from the CPU circuit section 150 to the finisher controller 501. When a sheet P is discharged from the image forming apparatus 10, the CPU 550 starts a punching process as a subroutine (step S105). In the punching process, a lateral registration shift of the sheet P is corrected, and punching is performed. The punching process will be described in detail hereinafter with reference to FIG. 10. It should be noted that the punching process is started and executed on a sheet-by-sheet basis.

Next, the CPU 550 determines whether or not the punching process is for the last sheet P in the job (step S106). If it is determined that the punching process is not for the last sheet P, the CPU 550 returns the process to the step S104. On the other hand, if it is determined that the punching process is for the last sheet P, the CPU 550 awaits termination of the punching process for the last sheet P (step S107). When the punching process for the last sheet P is terminated, the CPU 550 shifts the side edge sensor 1104 to the home position (step S108) and stops the motors of the conveying system (step S109), followed by terminating the present punch mode process.

Figure 7:
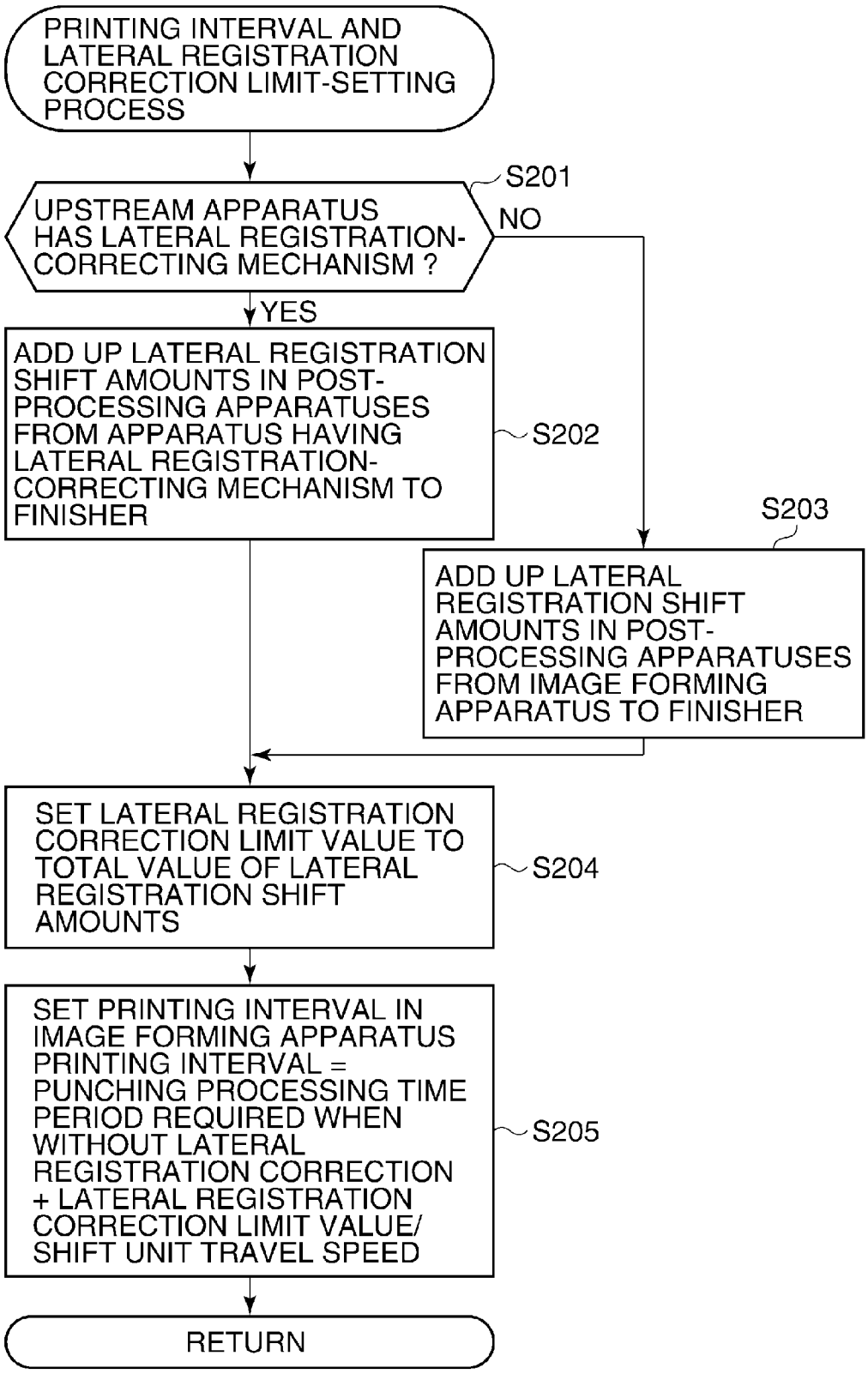
FIG. 7 is a detailed flowchart of a printing interval and lateral registration correction limit-setting process executed in a step of the punch mode process in FIG. 6.

FIG. 7 is a detailed flowchart of the printing interval and lateral registration correction limit-setting process executed in the step S101. In the printing interval and lateral registration correction limit-setting process, the lateral registration correction limit value is set according to post-processing apparatuses connected upstream of the finisher 500 provided with the punching unit 750, and the printing interval in the image forming apparatus 10 is set according to the limit value.

As shown in FIG. 7, first, the CPU 550 determines whether or not any post-processing apparatus disposed between the finisher 500 and the image forming apparatus 10 has a lateral registration-correcting mechanism (step S201). In the case of the image forming system 1000' in FIG. 2, where three post-processing apparatuses are connected in series to the image forming apparatus 10 at locations upstream of the finisher 500, it is determined whether or not any of the post-processing apparatuses 951 to 953 is provided with a lateral registration-correcting mechanism. The result of the determination is sent to the finisher controller 501 via the CPU circuit section 150 of the image forming apparatus 10.

If it is determined in the step S201 that any of the upstream apparatuses is provided with the lateral registration-correcting mechanism, the CPU 550 adds up the amount of lateral registration shift assumed to be caused in each post-processing apparatus disposed between the post-processing apparatus having the lateral registration-correcting mechanism and the finisher 500 (step S202). The amount of lateral registration shift (distance corresponding to the lateral registration shift) assumed to be caused in a post-processing apparatus is stored in advance in the control section of each associated one of the post-processing apparatus(es), and is sent to the finisher controller 501 via the CPU circuit section 150.

On the other hand, if it is determined in the step S201 that no upstream apparatus is provided with the lateral registration-correcting mechanism, the CPU 550 adds up the amount of lateral registration shift assumed to be caused in each post-processing apparatus disposed between the image forming apparatus 10 and the finisher 500 (step S203).

Then, the CPU 550 sets the total lateral registration shift amount obtained in the step S202 or S203 as a lateral registration correction limit value (step S204). The lateral registration correction limit value is indicative of a maximum lateral registration shift amount that can be corrected by lateral registration shift correction performed by the shift unit 1001. In other words, the limit value is defined as a maximum distance that the shift unit 1001 is permitted to travel for lateral registration shift correction.

Next, the CPU 550 calculates and sets a printing interval (time interval) of the image forming apparatus 10 based on the lateral registration correction limit value (step S205). A punching processing time period corresponds to a time period from the start of an operation for lateral registration correction to completion of an operation of the shift unit 1001 for returning to the standby position. Therefore, the printing interval in the image forming apparatus 10 can be calculated using the following equation (1):

printing interval=punching processing time period required when without lateral registration correction+lateral registration correction limit value/shift unit travel speed (1)

The CPU 550 sends the thus calculated printing interval to the CPU circuit section 150. The CPU circuit section 150 controls the printing interval in the image forming apparatus 10, i.e. the conveying interval (time interval) of sheets P according to the received printing interval.

Figures 14A, 14B:
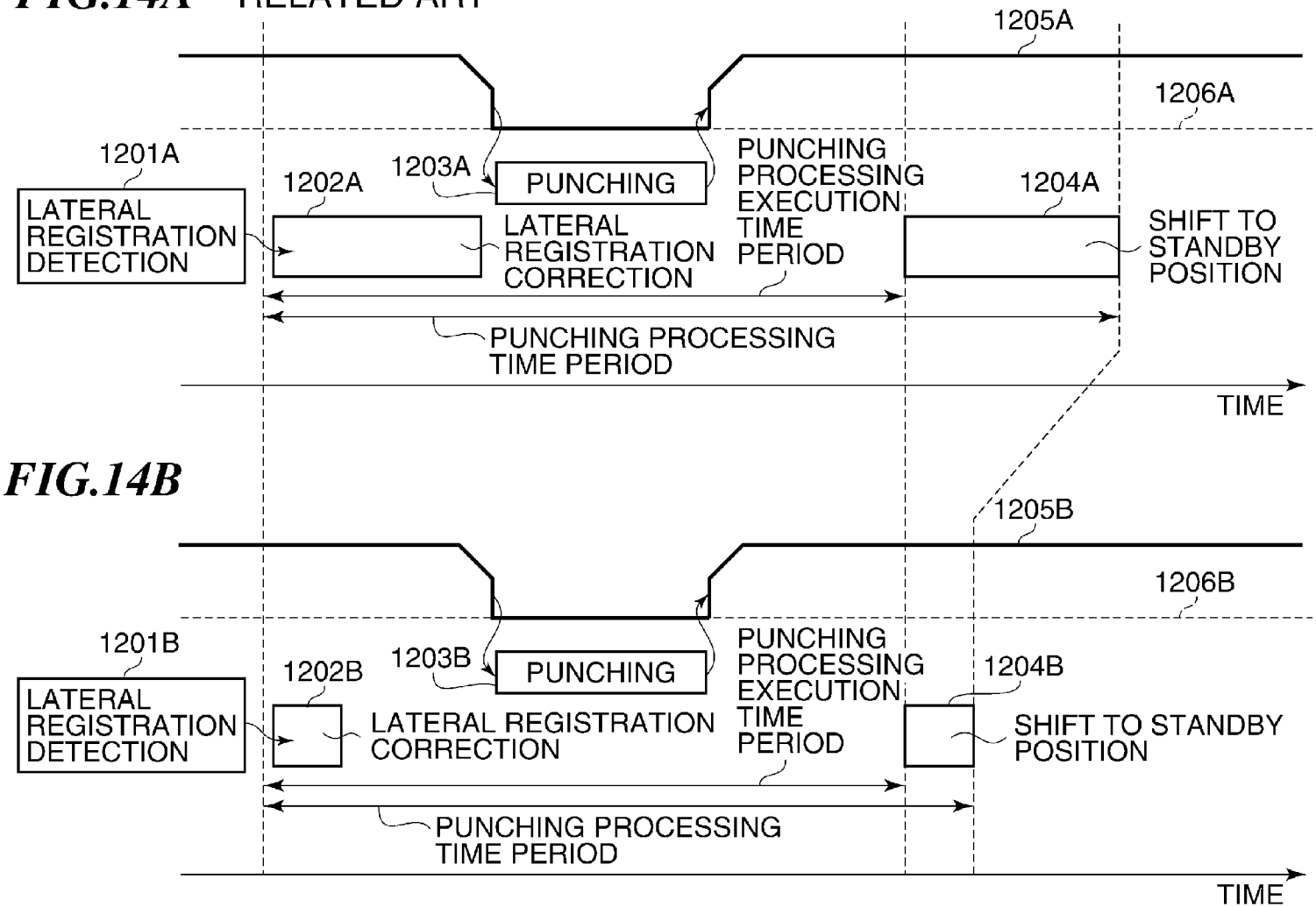
FIG.14A RELATED ART
FIGS. 14A and 14B are timing diagrams showing relationship in timing of lateral registration correction and punching.

The finisher 500 as the sheet processing apparatus according to the present embodiment performs a punching operation and a lateral registration correction operation, and hence requires time for completing both the operations (i.e. punching processing time period=punching processing execution time period including time period required for lateral registration correction+time period required for the sheet shifting unit to return to the standby position), as shown in the timing diagrams in FIGS. 14A and 14B. As to a time period required for completing the lateral registration correction operation (time period required for lateral registration correction+time period required for the shift unit to return to the standby position), if any post-processing apparatus at an upstream location is equipped with a lateral registration-correcting mechanism, the lateral registration correction is once performed at the post-processing apparatus, and hence it is only necessary to correct the total of amounts of lateral registration shift occurring only at other post-processing apparatuses which are not equipped with the lateral registration-correcting mechanism and disposed between the post-processing apparatus and the finisher 500. Therefore, the time period required for completing the lateral registration correction operation is shorter than when no upstream post-processing apparatuses are equipped with a lateral registration-correcting mechanism, and accordingly, the punching processing time period at the finisher 500 can be made shorter. This makes it possible to make shorter the conveying interval of the sheets P. In this case, however, it is assumed that the time required for the finisher 500 to perform punching per se is longer than time required for any type of post processing per se executed at any of the upstream post-processing apparatuses.

As described above, in the printing interval and lateral registration correction limit-setting process, when an upstream apparatus is provided with the lateral registration-correcting mechanism, the amounts of lateral registration shifts assumed to be caused in respective post-processing apparatuses disposed between the post-processing apparatus having the lateral registration-correcting mechanism and the finisher 500 are added up, and the conveying interval of the sheets P is determined based on the total lateral registration shift amount. Besides this, a method can be envisaged in which the conveying interval of the sheets P is determined based on whether or not there is disposed any upstream apparatus provided with the lateral registration-correcting mechanism or based on the number of upstream apparatuses. In the following, a description will be given of a printing interval and lateral registration correction limit-setting process associated with each of the above-mentioned cases.

Figure 8:
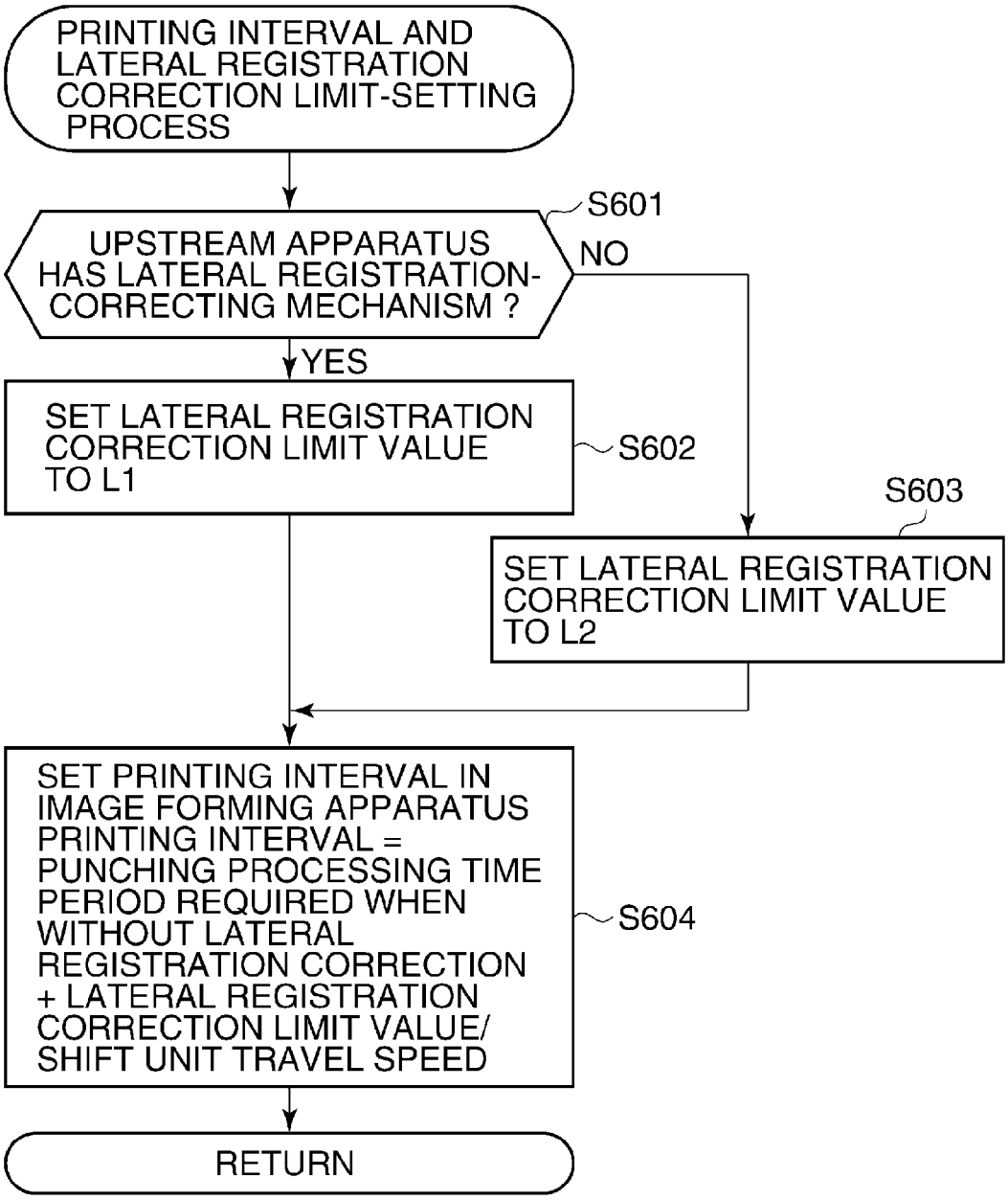
FIG. 8 is a detailed flowchart of another printing interval and lateral registration correction limit-setting process.

FIG. 8 is a detailed flowchart of another printing interval and lateral registration correction limit-setting process. In the present process, the conveying interval of the sheets P is determined based on whether or not there is disposed any upstream apparatus provided with the lateral registration-correcting mechanism.

As shown in FIG. 8, first, the CPU 550 determines whether or not any post-processing apparatus disposed between the finisher 500 and the image forming apparatus 10 has the lateral registration-correcting mechanism (step S601). In the case of the image forming system 1000' in FIG. 2, where the three post-processing apparatuses are connected in series to the image forming apparatus 10, it is determined whether or not any of the post-processing apparatuses 951 to 953 is provided with the lateral registration-correcting mechanism. The result of the determination is sent to the finisher controller 501 via the CPU circuit section 150 of the image forming apparatus 10.

If it is determined in the step S601 that there is an upstream apparatus provided with the lateral registration-correcting mechanism, the CPU 550 sets the lateral registration correction limit value to L1 (mm) (step S602). The lateral registration correction limit value L1 is a predicted value indicative of a lateral registration shift amount expected in a case where any of the post-processing apparatuses has the lateral registration-correcting mechanism. This value L1 is stored in advance in the ROM 551 of the finisher controller 501.

On the other hand, if it is determined in the step S601 that there is no upstream apparatus provided with the lateral registration-correcting mechanism, the CPU 550 sets the lateral registration correction limit value to L2 (mm) (step S603). The lateral registration correction limit value L2 is a predicted value indicative of a lateral registration shift amount expected in a case where none of the post-processing apparatuses has the lateral registration-correcting mechanism. This value L2 is larger than the lateral registration correction limit value L1. The lateral registration correction limit value L2 is also stored in advance in the ROM 551 of the finisher controller 501.

Next, the CPU 550 calculates and sets a printing interval in the image forming apparatus 10 based on the lateral registration correction limit value set in the step S602 or S603 (step S604). The method of calculating the printing interval is the same as the method described in the step S205, and therefore description thereof is omitted.

The CPU 550 sends the thus calculated printing interval to the CPU circuit section 150. The CPU circuit section 150 controls the printing interval in the image forming apparatus 10 according to the received printing interval.

Figure 9:
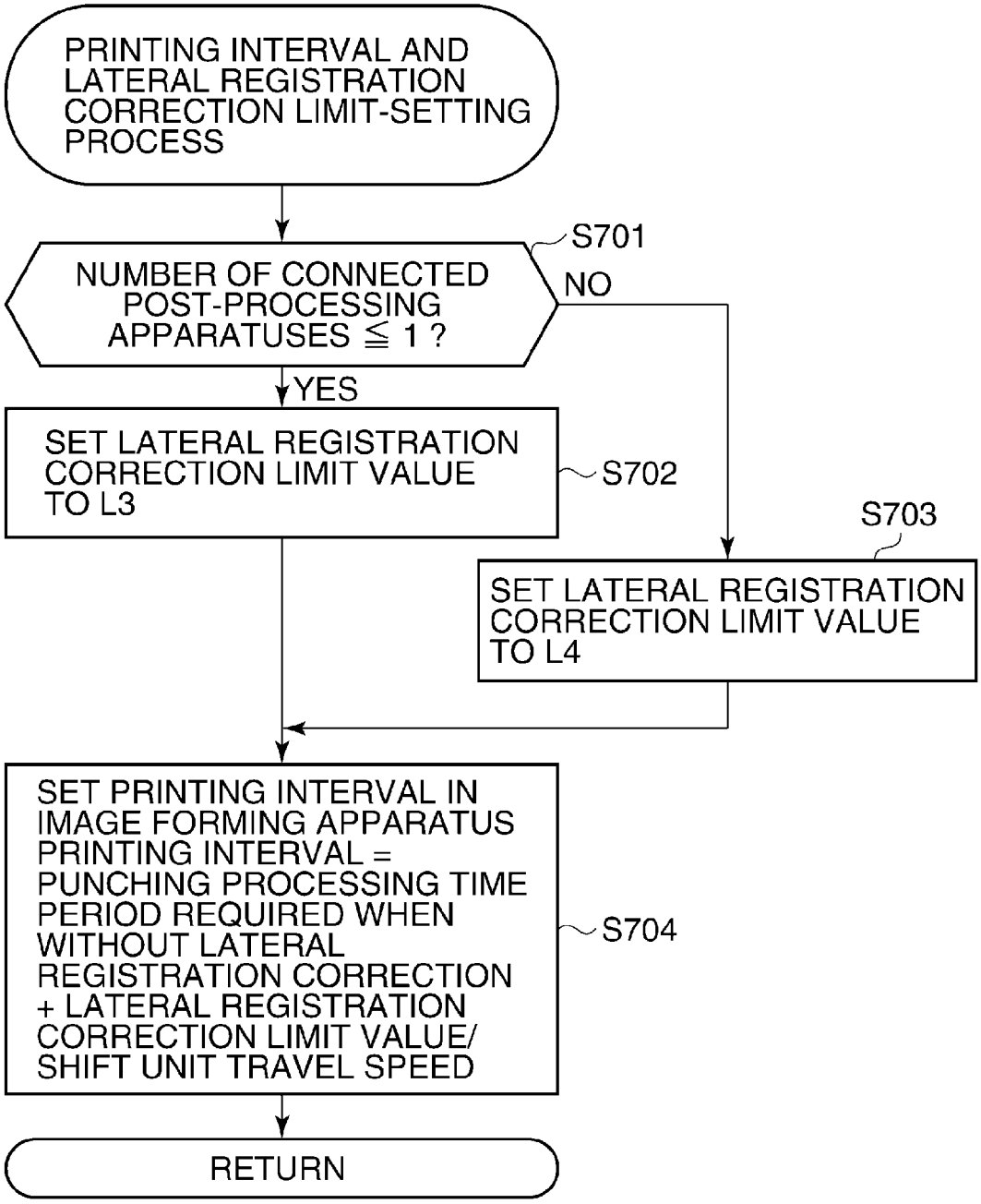
FIG. 9 is a detailed flowchart of still another printing interval and lateral registration correction limit-setting process.

FIG. 9 is a detailed flowchart of still another printing interval and lateral registration correction limit-setting process. In this process, the conveying interval of the sheets P is determined based on the number of upstream apparatuses.

As shown in FIG. 9, first, the CPU 550 determines whether or not there is one or less post-processing apparatus between the finisher 500 and the image forming apparatus 10 (step S701).

If it is determined in the step S701 that the number of upstream apparatuses is one or less, the CPU 550 sets the lateral registration correction limit value to L3 (mm) (step S702). The lateral registration correction limit value L3 is a predicted value indicative of a lateral registration shift amount expected in a case where the number of upstream post-processing apparatuses is one or less. This value L3 is stored in advance in the ROM 551 of the finisher controller 501.

On the other hand, if it is determined in the step S701 that the number of the upstream apparatuses is two or more, the CPU 550 sets the lateral registration correction limit value to L4 (mm) (step S703). The lateral registration correction limit value L4 is a predicted value indicative of a lateral registration shift amount expected in a case where the number of the upstream post-processing apparatuses is two or more. This value L4 is larger than the lateral registration correction limit value L3. The lateral registration correction limit value L4 is also stored in advance in the ROM 551 of the finisher controller 501.

Next, the CPU 550 calculates and sets a printing interval in the image forming apparatus 10 based on the lateral registration correction limit value set in the step S702 or S703 (step S704). This method of calculating the printing interval is also the same as the method described in the step S205, and therefore description thereof is omitted.

The CPU 550 sends the thus calculated printing interval to the CPU circuit section 150. The CPU circuit section 150 controls the printing interval in the image forming apparatus 10 according to the received printing interval.

Figure 10:
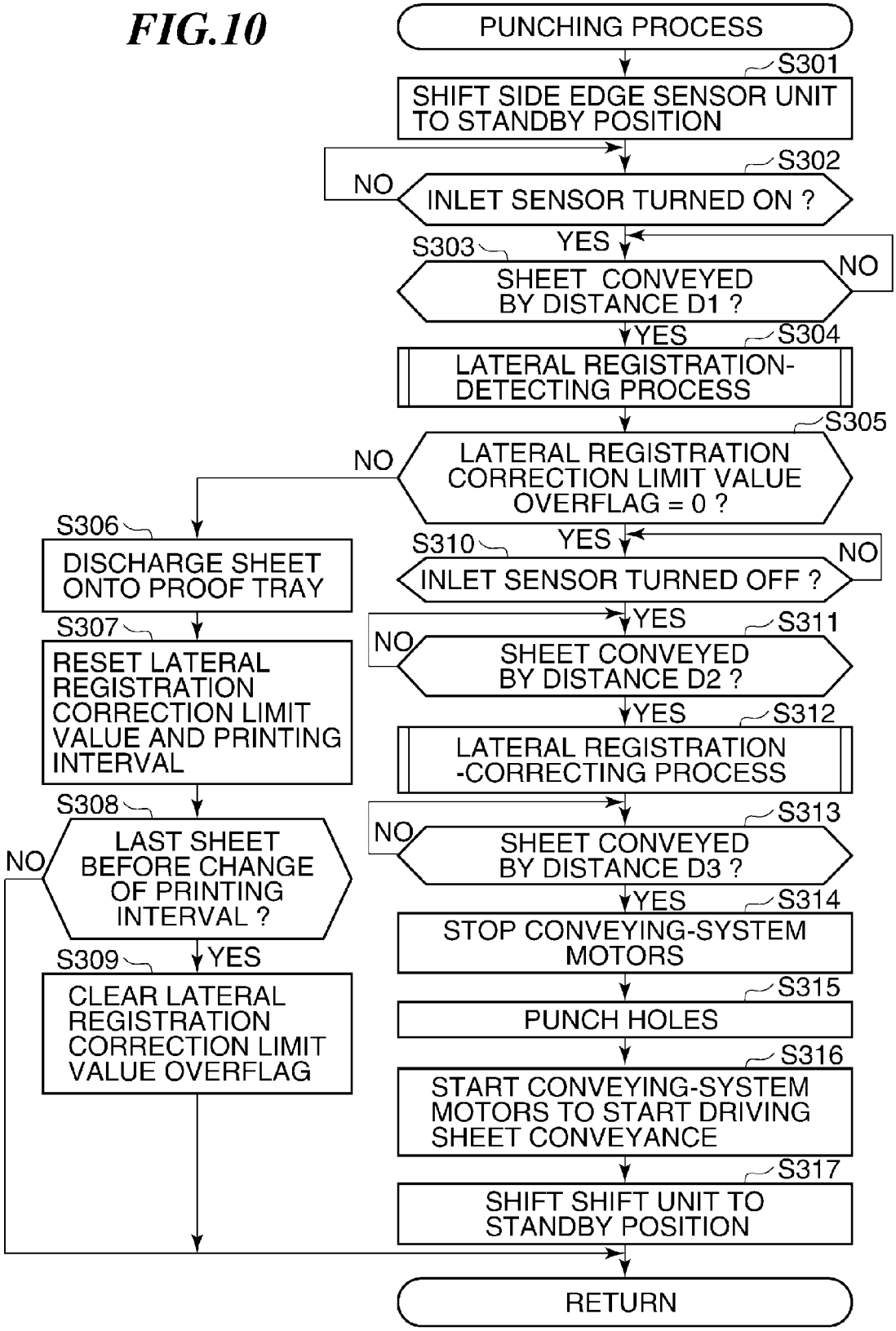
FIG. 10 is a detailed flowchart of a punching process executed in FIG. 5.

FIG. 10 is a detailed flowchart of the punching process executed in the step S105.

As shown in FIG. 10, first, the CPU 550 shifts the side edge sensor unit 1105 to a standby position determined according to the size (size in a lateral direction orthogonal to the sheet conveying direction) of each sheet P (step S301). Size information on each sheet P is sent from the CPU circuit section 150 to the finisher controller 501. Standby positions associated with respective sheet P sizes are stored in advance in the ROM 551 within the finisher controller 501.

Then, the CPU 550 awaits the turn-on of the inlet sensor 531 (step S302). When the inlet sensor 531 is turned on, the CPU 550 waits for the sheet P to be conveyed by a distance D1 (mm) after the turn-on of the inlet sensor 531 (step S303). The distance D1 is a distance that a sheet P is to be conveyed after the turn-on of the inlet sensor 531 until a position where lateral registration of the sheet P can be detected by the side edge sensor 1104 is reached.

When the sheet P is conveyed by the distance D1 after the turn-on of the inlet sensor 531, a lateral registration-detecting process is executed (step S304). In the lateral registration-detecting process, a shift of the sheet P in the lateral direction orthogonal to the sheet conveying direction is detected. This process will be described in detail hereinafter with reference to FIG. 11.

Next, the CPU 550 determines whether or not a lateral registration correction limit value overflag is set to "0" (step S305). The value of the lateral registration correction limit value overflag is set based on the result of lateral registration shift detection by the lateral registration-detecting process. Specifically, when the detected lateral registration shift amount is larger than the lateral registration correction limit value set in any of the above-described printing interval and lateral registration correction limit-setting processes, the lateral registration correction limit value overflag is set to "1". If the lateral registration correction limit value overflag is set to "1", the CPU 550 determines that a conveyance abnormality has occurred, and a failsafe process is executed in the following steps S306 to S309.

In the failsafe process, first, the CPU 550 discharges the sheet P onto a proof tray 701 (step S306). Then, the CPU 550 resets the printing interval in the image forming apparatus 10 (step S307). Specifically, the CPU 550 resets the lateral registration correction limit value to the lateral registration shift amount detected by the lateral registration-detecting process+$\alpha$, and then calculates the printing interval in the image forming apparatus 10 based on the equation (1), followed by resetting the printing interval to the calculated value. Immediately after completion of the resetting of the printing interval, the CPU circuit section 150 of the image forming apparatus 10 changes the printing interval to the newly reset value, and performs control such that an image formed on the sheet discharged onto the proof tray 701 is printed on a sheet again and the printed sheet is delivered. It should be noted that sheets which are not determined to be abnormal are discharged into the tray 700.

Next, the CPU 550 determines whether or not the sheet P is the last one conveyed before the change of the printing interval (step S308). The CPU 550 performs this determination based on information sent from the CPU circuit section 150. If the sheet P is the last one conveyed before the change of the printing interval, the CPU 550 clears the lateral registration correction limit value overflag (i.e. sets the flag to "0") (step S309), followed by terminating the present punching process. On the other hand, if the sheet P is not the last one, the CPU 550 immediately terminates the present punching process.

On the other hand, if it is determined in the step S305 that the lateral registration correction limit value overflag is set to "0", the CPU 550 executes the following steps S310 to S317 for lateral registration shift correction and hole punching.

First, the CPU 550 awaits the turn-off of the inlet sensor 531 (step S310). When the inlet sensor 531 is turned off, the CPU 550 waits for the sheet P to be conveyed by a distance D2 (mm) after the turn-off of the inlet sensor 531 (step S311). The distance D2 is a distance over which the sheet P is conveyed after the turn-off of the inlet sensor 531 until a position where the sheet P can be shifted by the shift unit 1001 is reached.

When the sheet P is conveyed by the distance D2 after the turn-off of the inlet sensor 531, the CPU 550 executes the lateral registration-correcting process (step S312). In the lateral registration-correcting process, the lateral registration shift of the sheet P is corrected based on the result of detection by the lateral registration-detecting process. This process will be described in detail hereinafter with reference to FIG. 12.

Then, the CPU 550 waits for the sheet P to be conveyed by a distance D3 (mm) after the turn-off of the inlet sensor 531 (step S313). The distance D3 is a distance over which the sheet P is conveyed after the turn-off of the inlet sensor 531 until a position where the sheet P is stopped for punching is reached.

When the sheet P is conveyed by the distance D3 after the turn-off of the inlet sensor 531, the CPU 550 stops the motors of the conveying system (step S314).

Next, the CPU 550 carries out a hole-punching operation for punching holes in the sheet P (step S315). In the hole-punching operation, the punch motor M1109 is driven to move a punch, whereby punched holes are formed in the sheet P.

When the hole-punching operation is completed, the CPU 550 starts driving the motors of the conveying system to restart conveyance of the sheet P (step S316).

Next, the CPU 550 causes the shift unit 1001 to be shifted to a standby position (step S317), followed by terminating the present punching process.

FIG. 11 is a detailed flowchart of the lateral registration-detecting process executed in the step S304 of the punching process in FIG. 10.

As shown in FIG. 11, first, the CPU 550 determines whether or not the side edge sensor 1104 is on (step S401). If the CPU 550 determines that the side edge sensor 1104 is on, the process proceeds to a step S402.

In the step S402, the CPU 550 drives the side edge sensor-shifting motor M1106 to shift the side edge sensor unit 1105 in an A direction. The A direction is a direction indicated by the arrow 43 in FIG. 4, in which the side edge sensor 1104 on the side edge sensor unit 1105 will eventually cease to detect the sheet P.

Next, the CPU 550 stores the direction of the lateral registration shift as the A direction, in the RAM 552 (step S403), and then starts counting of a shift distance of the side edge sensor 1104 (step S404). Thereafter, the process proceeds to a step S409.

In the step S409, the CPU 550 determines whether or not the side edge sensor 1104 has been turned off. Until the side edge sensor 1104 has been turned off, the step S409 is repeatedly carried out. On the other hand, if the CPU 550 determines that the side edge sensor 1104 has been turned off, the process proceeds to a step S410.

On the other hand, if the CPU 550 determines in the step S401 that the side edge sensor 1104 is off, the CPU 550 drives the side edge sensor-shifting motor M1106 to shift the side edge sensor unit 1105 in a B direction (step S405). The B direction is a direction indicated by the arrow 44 in FIG. 4, in which the side edge sensor 1104 on the side edge sensor unit 1105 will eventually come to detect the sheet P.

Next, the CPU 550 stores the direction of the lateral registration shift as the B direction, in the RAM 552 (step S406), and then starts counting of a shift distance of the side edge sensor 1104 (step S407). Thereafter, the process proceeds to a step S408.

In the step S408, the CPU 550 determines whether or not the side edge sensor 1104 has been turned on. Until the side edge sensor 1104 has been turned on, the step S408 is repeatedly carried out. On the other hand, if the CPU 550 determines that the side edge sensor 1104 has been turned on, the process proceeds to the step S410.

In the step S410, the CPU 550 stores the count value X of the shift distance of the side edge sensor 1104 performed by the CPU 550 from the start of driving of the side edge sensor-shifting motor M1106 to the turn-on or turn-off of the side edge sensor 104 as a lateral registration shift amount in the RAM 552.

Next, the CPU 550 stops the side edge sensor-shifting motor M1106 (step S411), and clears the count value X of the shift distance of the side edge sensor 1104 (step S412).

Next, the CPU 550 drives the side edge sensor-shifting motor M1106 to shift the side edge sensor unit 1105 to the standby position (step S413). Then, the CPU 550 determines whether the detected lateral registration shift amount is not larger than the lateral registration correction limit value (step S414). If the detected lateral registration shift amount is larger than the lateral registration correction limit value, the CPU 550 sets the lateral registration correction limit value overflag to "1" (step S415), followed by terminating the present lateral registration-detecting process. On the other hand, if the detected lateral registration shift amount is not larger than the lateral registration correction limit value, the CPU 550 immediately terminates the present lateral registration-detecting process. It should be noted that detecting the lateral registration shift amount corresponds to detecting the relative distance in the lateral direction orthogonal to the sheet conveying direction between a center line of a sheet P and a center line of the punching unit 750 (determining the punching position thereof). Therefore, in the step S414, it is determined whether the relative distance in the lateral direction orthogonal to the sheet conveying direction between the center line of the sheet P and the center line of the punching unit 750 is not larger than the predetermined value (lateral registration correction limit value) (to put it in an inverted logic, whether the relative distance is larger than the predetermined value).

Figure 12:
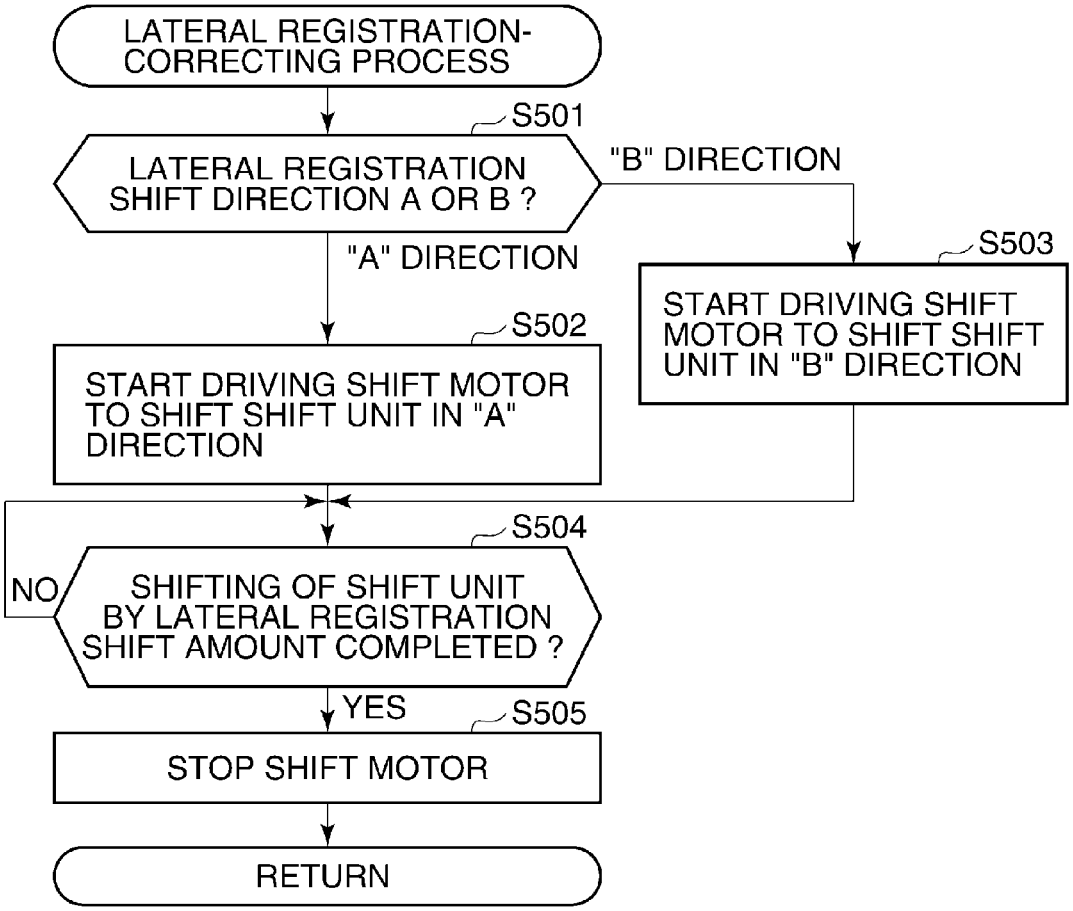
FIG. 12 is a detailed flowchart of a lateral registration-correcting process executed in FIG. 10.

FIG. 12 is a detailed flowchart of the lateral registration-correcting process executed in the step S312. The present lateral registration-correcting process is executed so as to align the respective relative positions of the punching unit 750 and a sheet P.

Figure 13A:
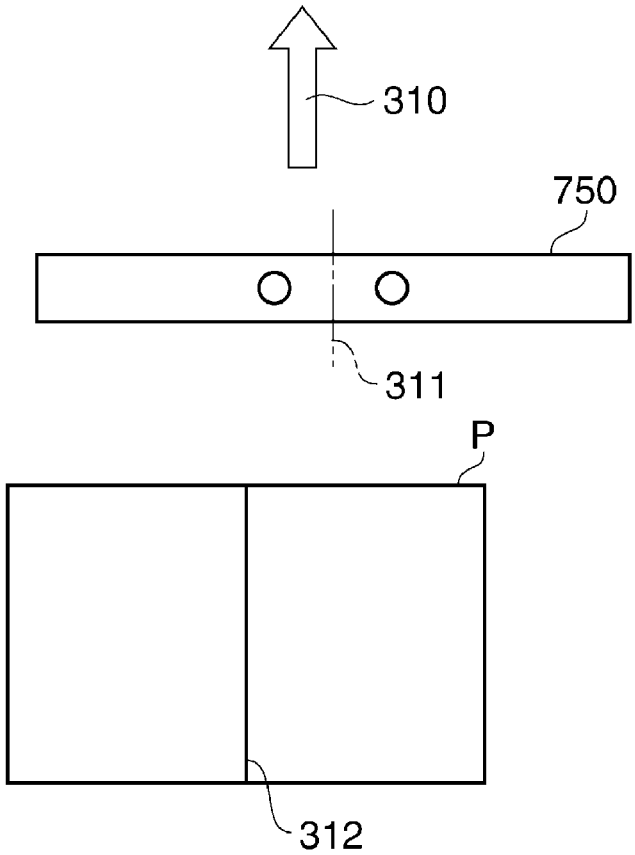
FIG. 13A is a view illustrating a state before respective relative positions of a punching unit appearing in FIG. 3 and a sheet are aligned with a desired punching position.
Figure 13B:
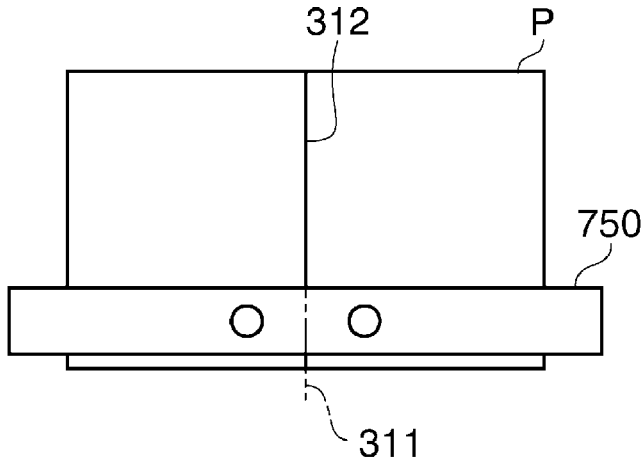
FIG. 13B is a view illustrating a state after the respective relative positions of the punching unit appearing in FIG. 3 and the sheet are aligned with the desired punching position.

FIG. 13A is a view illustrating a state before the respective relative positions of the punching unit 750 and the sheet P are aligned with a desired punching position where punching should be performed, and FIG. 13B is a view illustrating a state after the respective relative positions of the same are aligned with the desired punching position. An arrow 310 in FIG. 13A indicates the conveying direction of the sheet P. As shown in FIGS. 13A and 13B, the respective relative positions of the punching unit 750 and the sheet P are adjusted such that a center line 311 of the punching unit 750 and a center line 312 of the sheet P are aligned with each other. As a consequence, the punching position of the punching unit 750 is aligned with the desired punching position on the sheet P.

Although in the present lateral registration-correcting process, the relative positions are aligned by moving a sheet P, the relative positions may be aligned by moving the punching unit 750 or by moving both the punching unit 750 and the sheet P.

Referring to FIG. 12, first, the CPU 550 determines whether the direction of the lateral registration shift detected by the lateral registration-detecting process in FIG. 11 is the A direction or the B direction (step S501). If it is determined in the step S501 that the direction of the detected lateral registration shift is the A direction, the CPU 550 starts driving the shift motor M1107 in such a direction that the shift unit 1001 moves in the A direction (step S502). On the other hand, if it is determined in the step S501 that the direction of the detected lateral registration shift is in the B direction, the CPU 550 starts driving the shift motor M1107 in such a direction that the shift unit 1001 moves in the B direction (step S503).

Next, the CPU 550 determines, based on a driving amount of the shift motor M1107, whether or not the shift unit 1001 has been shifted by the lateral registration shift amount (step S504). If the shift unit 1001 has not been shifted by the lateral registration shift amount, the step S504 is repeatedly carried out until the shift unit 1001 has been shifted by the lateral registration shift amount. On the other hand, if it is determined in the step S504 that the shift unit 1001 has been shifted by the lateral registration shift amount, the CPU 550 stops the shift motor M1107 (step S505), followed by terminating the present lateral registration-correcting process.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2009-242365, filed Oct. 21, 2009, which is hereby incorporated by reference herein in its entirety.

What is claimed is:

1. A sheet processing apparatus connected downstream of an image forming apparatus that forms an image on a sheet, comprising:

a post-processing unit configured to perform post processing on the sheet;

a shift unit configured to shift at least one of the sheet and said post-processing unit so as to adjust a position for performing the post processing on the sheet;

a determination unit configured to determine whether or not a post-processing apparatus connected between the sheet processing apparatus and the image forming apparatus is provided with a correction mechanism for correcting a position of a sheet in a direction orthogonal to a sheet conveying direction; and a setting unit configured to be operable when said determination unit determines that the post-processing apparatus is provided with the correction mechanism, to cause the image forming apparatus to be set such that a conveying interval of sheets becomes shorter than when the post-processing apparatus is not provided with the correction mechanism.

2. The sheet processing apparatus according to claim 1, wherein when the post-processing apparatus is provided with the correction mechanism, said setting unit sets an upper limit of a distance over which at least one of the sheet and said post-processing unit is shifted by said shift unit, such that the upper limit is shorter than when the post-processing apparatus is not provided with the correction mechanism.

3. The sheet processing apparatus according to claim 1, wherein said shift unit comprises a sheet shifting unit configured to shift the sheet in the direction orthogonal to the sheet conveying direction, and a detection unit configured to detect a side edge of the sheet in the direction orthogonal to the sheet conveying direction, and wherein said shift unit shifts the sheet using said sheet shifting unit, based on a result of detection by said detection unit, to thereby adjust the position for performing the post processing, in the direction orthogonal to the sheet conveying direction.

4. The sheet processing apparatus according to claim 3, further comprising an abnormal sheet discharge tray into which sheets suffering from conveyance abnormality are discharged, and wherein when it is determined, based on the result of the detection by said detection unit, that a relative distance between the sheet and said post-processing unit is larger than a predetermined value, said setting unit causes the sheet to be discharged into said abnormal sheet discharge tray and causes the image forming apparatus to be set such that the conveying interval of subsequent sheets is increased.

5. The sheet processing apparatus according to claim 1, wherein said post-processing unit is a punching unit for punching holes in the sheet, and wherein said shift unit shifts at least one of the sheet and said punching unit so as to adjust a position for punching the holes in the sheet.

* * * * *